US005931633A

United States Patent [19]

Weggelaar

[11] Patent Number: 5,931,633

[45] Date of Patent: Aug. 3, 1999

[54] ORDER-COLLECTION APPLIANCE FOR COLLECTING ORDERS IN WAREHOUSES WITH PALLETIZED STORAGE OF GOODS

[75] Inventor: Franciscus G. A. Weggelaar, The Hague, Netherlands

[73] Assignee: Cardos B.V., Netherlands

[21] Appl. No.: 08/938,445

[22] Filed: Sep. 26, 1997

[30] Foreign Application Priority Data

Oct. 2, 1996 [NL] Netherlands ..... 1004177

[51] Int. Cl.[6] ..... B66F 9/06

[52] U.S. Cl. ..... 414/626; 294/67.22

[58] Field of Search ..... 414/621, 622, 414/626; 294/67.22, 67.2, 117

[56] References Cited

U.S. PATENT DOCUMENTS

| | | | |
|---|---|---|---|
| 1,826,489 | 10/1931 | Abbe | 414/622 |
| 1,847,819 | 3/1932 | Davies | 294/67.2 |
| 2,520,564 | 8/1950 | Reagle | 414/622 |
| 2,535,961 | 12/1950 | Schutt | 414/626 X |
| 2,624,470 | 1/1953 | Geist | 414/626 X |
| 2,828,039 | 3/1958 | Puim | 414/622 |
| 3,039,810 | 6/1962 | Bellingher et al. | 414/622 X |
| 3,063,574 | 11/1962 | Peterson | 414/626 X |
| 3,104,016 | 9/1963 | Harry | 414/626 X |
| 3,258,287 | 6/1966 | Crosby | 294/67.22 X |
| 3,436,116 | 4/1969 | Anderson | 414/626 X |
| 3,759,399 | 9/1973 | Glass et al. . | |
| 4,000,923 | 1/1977 | Baldwin | 294/67.22 X |
| 4,095,752 | 6/1978 | Pomeret et al. . | |
| 4,320,915 | 3/1982 | Abbott et al. | 414/626 X |
| 4,375,936 | 3/1983 | Dechantsreiter | 414/626 |
| 4,708,574 | 11/1987 | Conboy | 414/626 X |
| 4,722,106 | 2/1988 | Scegiel et al. | 294/67.2 X |
| 4,797,059 | 1/1989 | Karg et al. | 414/626 X |
| 5,096,357 | 3/1992 | Galbani | 414/626 X |

FOREIGN PATENT DOCUMENTS

| | | | |
|---|---|---|---|
| 952746 | 11/1956 | Germany | 414/626 |
| 10 84 888 | 7/1960 | Germany . | |
| 1177863 | 9/1964 | Germany | 294/67.22 |
| 15 06 950 | 10/1969 | Germany . | |
| 2218579 | 4/1981 | Germany | 294/67.22 |
| 34 46 231 | 7/1985 | Germany . | |
| 88 08 399 | 9/1988 | Germany . | |
| 90 03 924 | 8/1990 | Germany . | |
| 42 37 058 | 5/1994 | Germany . | |
| 77249 | 8/1950 | Norway | 294/67.22 |
| 136871 | 1/1961 | U.S.S.R. | 294/67.22 |
| 772967 | 11/1980 | U.S.S.R. | 294/67.22 |

*Primary Examiner*—David A. Bucci
*Attorney, Agent, or Firm*—Deveau, Colton & Marquis

[57] ABSTRACT

An appliance for collecting orders in warehouses wherein various goods are stored on pallets, which appliance includes a scoop having a support blade and a handle mounted to a bracket, and also being provided with equipment for suspending the scoop from a hoist mounted on an order-collection truck. A spring-operated clamp can be provided, which serves to engage the top surface of an article carried by the scoop. The clamp may be configured to actuate automatically upon operation of the hoist, through the use of a hoisting wire guided over or attached to an element of the clamp and also attached to or guided over an element of the scoop's bracket.

5 Claims, 7 Drawing Sheets

ORDER-COLLECTION APPLIANCE FOR COLLECTING ORDERS IN WAREHOUSES WITH PALLETIZED STORAGE OF GOODS

BACKGROUND OF THE INVENTION

The invention relates to an order-collection appliance for collecting orders in warehouses with palletized storage of goods, the pallets, which contain only one item, being stored in pallet racks.

This situation occurs very frequently in wholesaler's warehouses (foodstuffs, paper goods, household goods, industrial items, etc.) and, to a lesser extent, also in warehouses belonging to the companies which produce such goods.

In all the abovementioned warehouses, orders are collected. For the most part, these orders consist of a plurality of items (order lines), usually with relatively small amounts of packages (boxes, trays, bags, packages, and the like) per order line. The scope of the order obviously differs for each company and for each customer, but in most cases it consists of one or more full pallets or rolling containers.

STATE OF THE ART

The order-collection methods employed can be differentiated on the basis of the type of truck used.

1) By means of non-lifting order-collection trucks.

The following method described is employed very frequently for the collection of the orders. The so-called order-collection pallets are situated on the floor spaces of the pallet racks and sometimes also the location just above these. The packages required for the various orders are collected from these pallets. The pallets of remaining stock of each item (the bulk stock) are situated in the upper pallet-rack sections. If an order-collection pallet is empty, it is removed by a fork-lift truck driver and replaced with a full pallet taken from the bulk stock.

Each package is picked up manually by the order collector and put down on a pallet which he/she brings long or in a rolling container. For transport, use is made of an electrically movable pallet truck or a non-lifting order-collection truck on which the order collector can also travel. When picking up the packages, the order collector dismounts from the truck, in contrast to the method employing the low-lifting and high-lifting order-collection trucks, in which he/she remains standing on the truck.

Electric pallet trucks and non-lifting order-collection trucks may also be designed such that up to two pallets or three rolling containers can be brought along simultaneously.

2) By means of low-lifting and high-lifting order-collection trucks.

In the case of low-lifting order-collection trucks, the platform on which the order collector stands can be raised about 1000 mm. As a result, it also becomes possible to reach an order-collection pallet on the second level of the pallet racks, as is required in certain cases.

If the layout of the store is suitable and/or a large number of order-collection locations are required on a limited floor area, so-called high-lifting order-collection trucks are also used to a limited extent. In these, the order collector is situated in a cab. In a specific design, a truck of this kind can also be used to stack and unstack pallets.

The order-collection methods employed exhibit the following drawbacks.

Each package has to be picked up manually by the order collector from the order-collection pallet and deposited on the pallet brought along (or in the rolling container). Depending on the loading situation of an order-collection pallet which has been opened up, the order collector alternately has to reach high, deep or low, for example up to 180 cm high, 120 cm deep or to just above the floor. The order collector then has to turn through 180° with the package in his/her hands and stack the said package on the pallet brought along (or in the rolling container). On average, this operation is performed, for example, at a rate of 150 packages per hour, that is to say 1200 times per day. With an average package weight of 5 kg (with a maximum of up to 15 to 20 kg), this represents 6000 kg per day. This is extremely hard work and is particularly bad for the back.

The productivity of an order collector is frequently measured by the average number of packages per hour which he/she collects. In practice, it has been found that productivity is considerably higher in the morning and the average falls considerably as the day progresses. The order-collection work takes place every day, year in year out, until the order collector's back has worn out and ultimately he/she has to report sick.

If high-lifting order-collection trucks are used, the order collector is in a better position for picking up the packages, primarily because the cab can be raised to the most suitable height. Nevertheless, for most of the packages on the order-collection pallet, the order collector has to reach deep into the compartment and thus bend relatively far out of the cab. In this case too, certainly with relatively heavy packages, the back is subject to an undesirable loading. This also applies to placing the packages on the pallet brought along.

It is true that industrial order-collection systems have been developed in order to facilitate or replace the task of the order collector. With these systems, the goods on pallets are conveyed to the order collector, for example, the order collector being situated at an optimally designed work station. These systems can only be used to a very limited extent and, in particular, are extremely expensive and unprofitable. The order-collection methods described above are therefore still the most common.

OBJECTS OF THE INVENTION

The object of the invention is to achieve by means of an order-collection appliance a great improvement, in obviating the abovementioned drawbacks and problems with prior methods. A further object is to do so in a very inexpensive and simple manner.

SUMMARY OF THE INVENTION

To this end, in the basic concept, said appliance is formed by a scoop comprising a support blade with a handle, mounted to a bracket, and provided with a means for suspending it from a hoisting wire of a hoisting installation on an order-collection truck.

The invention thus proposes a facility by means of which the order collector can scoop up and raise the packages (boxes, trays, bags, packages and the like) and then deposit them on the pallet brought along (or in the rolling-container). The hoisting installation is arranged on the order-collection truck. This is possible, albeit in slightly different ways, both with non-lifting and low-lifting order-collection trucks and with high-lifting order-collection trucks.

It is very advantageous when a spring-loaded clamp is provided, which serves to engage the top surface of an article carried by the scoop. This clamp prevents the article carried from shifting or falling off the scoop.

This idea can be realized simply when the clamp comprises a lever, mounted rotatably relative to the bracket.

The clamp may start to operate automatically as a result of the hoisting wire being guided over or attached to an element of the clamp lever and being attached to or guided over an element on the bracket.

The invention will be explained below on the basis of the attached drawing of an exemplary embodiment and of the manner in which it is employed.

THE PREFERRED EMBODIMENT

Figure 1C:
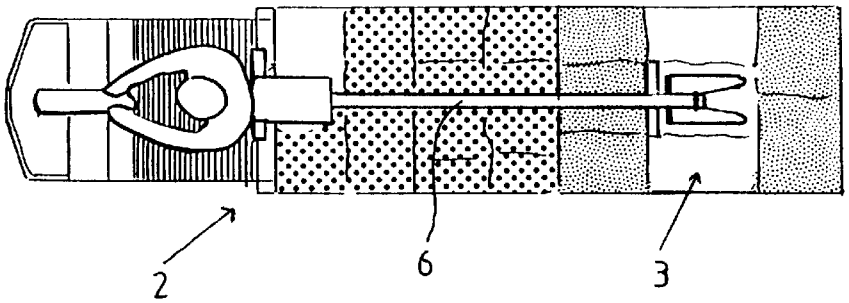
FIGS. 1*a* to 1*c* show a loaded order-collection truck on which provisions according to the invention are arranged, specifically in side view, rear view and top view, respectively.
Figure 1B:
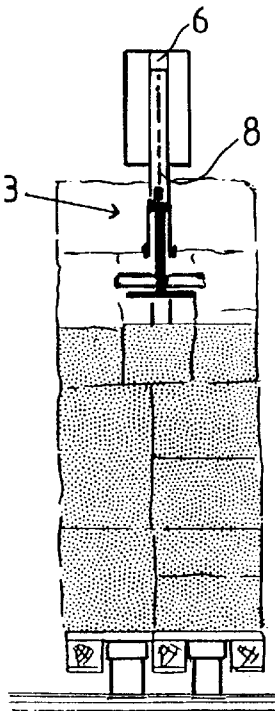
Figure 1A:
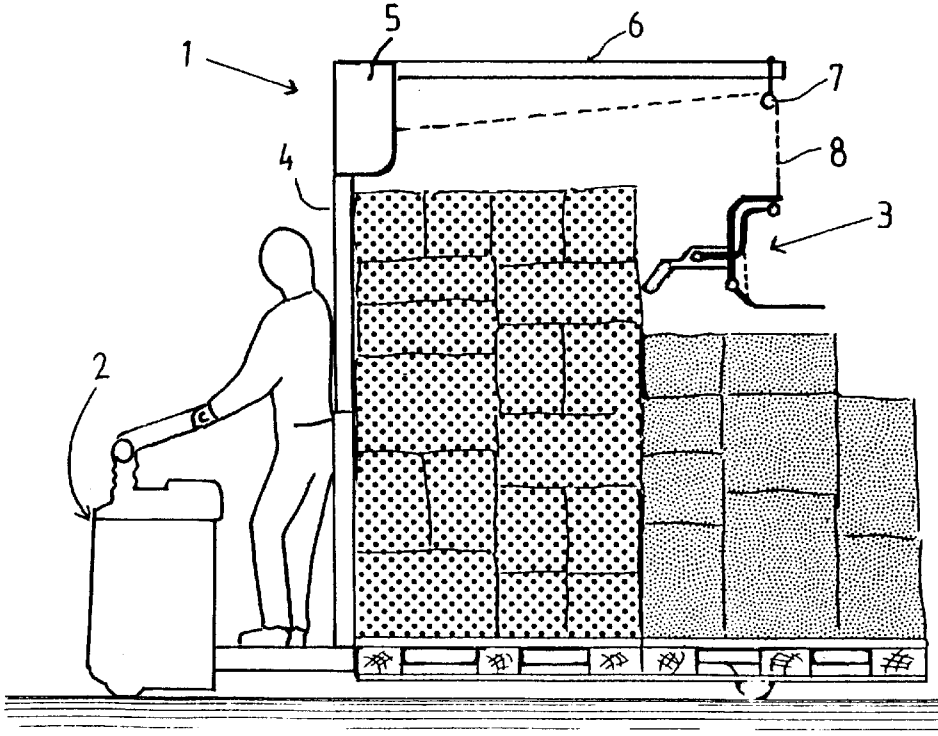

The order-collection appliance is composed of two main components, namely (cf. FIGS. 1*a* to *c*): the hoisting installation 1, which is fastened to the order-collection truck 2 and the order-collection scoop 3, which is suspended from the cable of the hoisting installation 1.

The hoisting installation 1 firstly comprises an upright structure 4, directly attached to the order-collection truck. At the top of this part is situated a hoisting gear 5 and a fastening means for the horizontal load bar 6. In the case of high-lifting order-collection trucks, the upright structure is not present, since the roof of the cab can be used for this purpose.

The horizontal load bar 6 may be produced from square tubing. Its length is adapted to the number and dimensions of the pallets or rolling containers which are brought along at the same time by the order-collection truck. In practice, the maximum length is 1850 mm for two pallets of 1200 mm deep. The minimum length is about 550 mm for one pallet of 1000 mm deep. For high-lifting order-collection trucks, the bar length is always determined by the depth of one pallet, since only one pallet can be transported.

A displaceable and moveable pulley 7 fits on the load bar 6 in order to pay out the hoisting wire 8. The pulley 7 is designed such that it can be displaced in the horizontal direction along the load bar 6 and, moreover, can be pivoted to the left and right. By displacing the pulley 7, the latter can be moved to the desired location in the center above the pallet (one or more) brought along.

The hoisting gear 5 is fastened to the top of the upright structure 4 or to the end of the horizontal load bar 6. The hoisting gear 5 comprises an electric motor, a transmission gearbox for reducing the rotational speed of the electric motor and a drum for winding up and unwinding the hoisting wire 8. The electronic control system for the purpose of operation (raising and lowering with the associated speed control) is also accommodated on the hoisting gear 5, as well as the radio receiver for signals from a transmitter on the scoop. The hoisting gear is furthermore provided with a slack-cable contact and an overload protection, comprising a slip coupling, as well as spring mechanism acting to prevent shocks on the scoop at the beginning of its motion. The power supply is drawn from the battery of the order-collection truck (24 volts direct current). The power consumption of the hoisting gear 5 is very low by comparison with the consumption of the order-collection truck itself, so that there is scarcely any extra load on the battery.

The hoisting wire 8 used is a plastic cord, of braided nylon for example, (approx. 5 mm) since this is sufficiently flexible and smooth and is also safe to use.

Figure 2B:
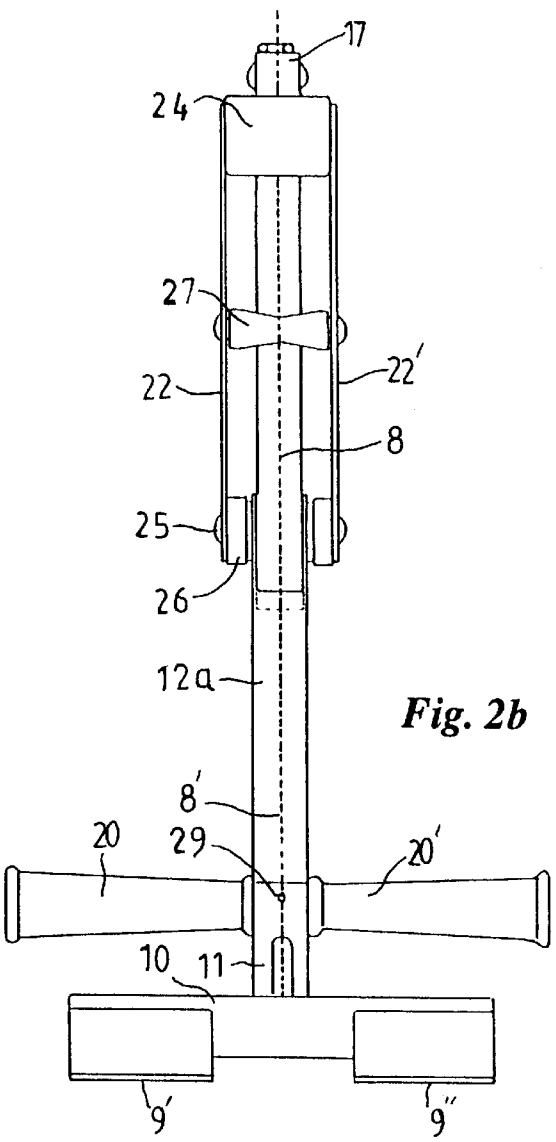
FIGS. 2*a* to 2*c* show the order-collection scoop, respectively in side view, top view and front view.

The order-collection scoop 3 comprises the following components (cf. FIG. 2*a* to 2*c*):

The support blade 9, is produced from smooth-finished (stainless) sheet metal; in the embodiment represented the blade has been realized as a pair of teeth 9', 9". The front thereof is thin and slightly round, in order to make it as easy as possible to slide the blade under a package. At the rear, the teeth 9', 9" are bent vertically upwards—denoted by 10—so that the packages can rest against it. The lower part 12*a* of a bracket 12*a,b* is also fastened to this part 10 by means of a connecting piece 11 and a welded joint. Piece 11 is a U-section, open at the top.

The bracket 12 comprises two telescopic parts, namely the lower part 12*a* and the upper part 12*b*.

In the embodiment illustrated, the lower part 12*a* is a square tube, a handle 13 with grip 14 are fastened. In the space below handle 13 the necessary electric circuits can be placed, with a radio transmitter for wireless transfer of signals to control the electric motor in the hoisting gear. This is indicated by a housing 15. Just in front of grip 14 an electric control knob 16 may be arranged. For manipulating the scoop there are also two handles 20, 20' attached to lower bracket part 12*a*.

The vertical piece 12*b* of the upper bracket part is also a square tube, which fits precisely in the square tube of the lower bracket part 12*a*. At the top, the vertical piece 12*b* is fastened to a horizontal piece 17, for example by welding, with an inclined transitional part 18. Piece 17, 18 is preferably made from sheet metal, bent into a reversed U, open at the bottom. It has, at the top, a slit shaped aperture surrounded by an oval ring 19 having a circular cross section, as a means to pass and guide wire 8. At an intermediate place, a roller 21 is mounted in piece 17, over which hoisting wire 8 runs and goes downward.

On either side of bracket 12 there is (cf. FIG. 2*c*) a. rotatable lever or arm 22, 22' of a clamp 23, being about S-shaped. Between the arms, at one of their ends, a roller 24 is rotatable about an axis. The other ends are rotatable about an axis 25 relative to the lower part 12*a* of bracket 12. Although also other solutions are feasible, the embodiment disclosed, a spring housing 26 is affixed to handle 13; this may be done by welding. The spring housing 26 contains, in a structure which is known in itself, a helical spring or another spring by which arms 22, 22' of clamp 23 are continuously under the influence of a force by which they are inclined to rotate in counter clockwise sense (seen in FIG. 2*a*). By this spring action roller 24 is urged against the horizontal part 17 of bracket 12.

Between arms 22, 22' another roller 27 is provided. A third roller 28 is provided near the bottom (see FIG. 2*a*) in the connecting piece 11 between support blade 9 and bracket 12. Furthermore a fixed point 29 is made to this connecting piece 11, to which the end 8' of hoisting wire 8 is attached. From there, as indicated in broken lines, the hoisting wire successively extends over roller 27 in the clamp, over stationary roller 28 near the bottom, and finally over stationary roller 21 in the top of the bracket.

Figure 2A:
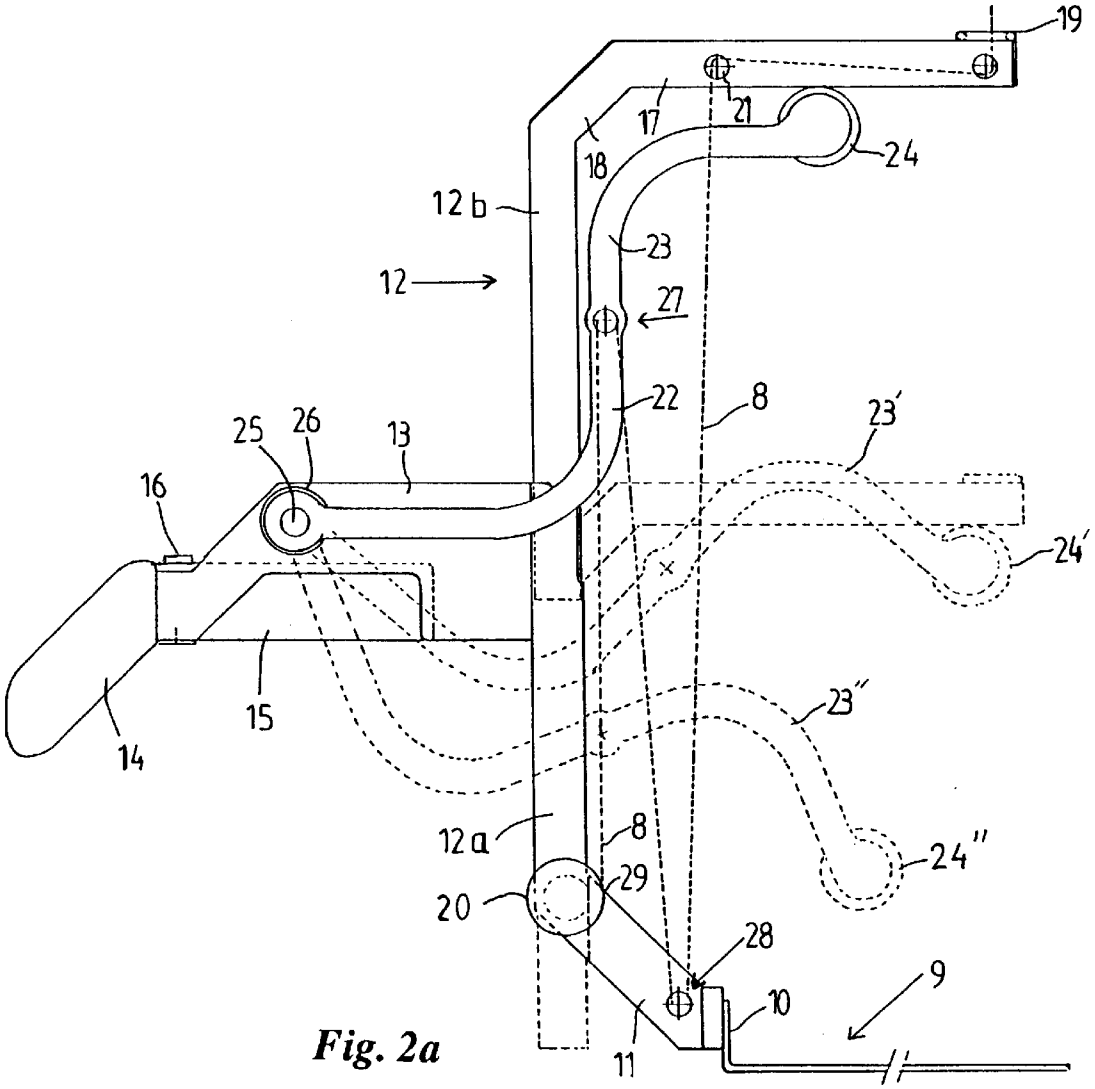
Figure 2C:
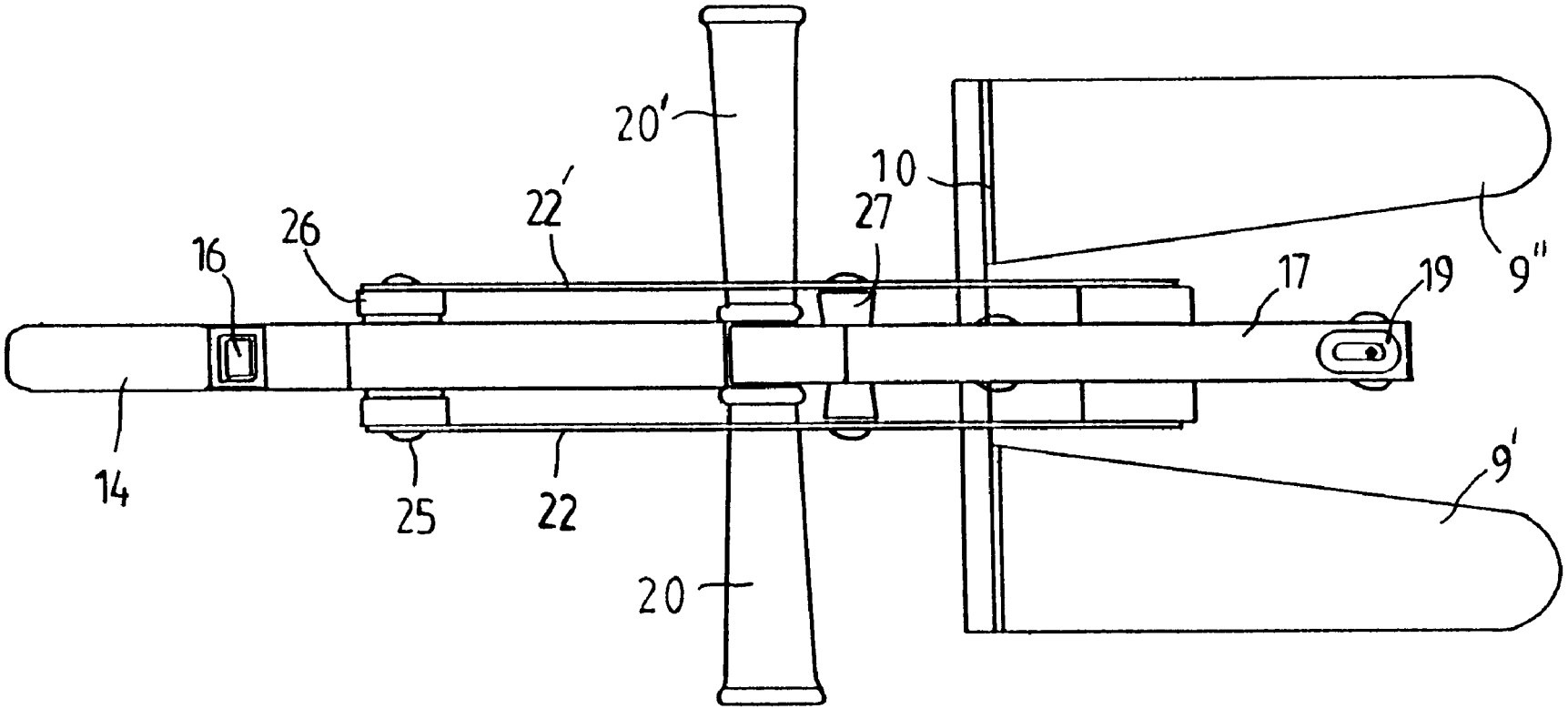

When an article, having a certain weight, is resting upon scoop fingers 9, 9', and when by operation of knob 16 the hoisting gear starts to hoist and hoisting wire 8 is brought under tension, this tension in the loop shaped wire part between fixation point 29 over roller 27 back to roller 28, will create a force which in turn will result in a moment of force counter clockwise about axis of rotation 25. As a result, clamp 23 will rotate in counter clockwise sense until the moment at which roller 24 comes to rest upon the article which is carried by the scoop so as to hold this article on the scoop. The force exerted by roller 24 onto the article is only a fraction of a hoisting wire tension as a result of an angle between the line of force extending between rollers 27 and 28 on the one hand and an arm of the moment of force extending between the axis of rotation 25 and roller 27, and furthermore as a consequence of the angle between the line connecting the axis of rotation 25 of clamp 23 and the axis of roller 24 with the horizontal. In FIG. 2*a* broken lines indicate an intermediate position 23', 24' at the lowermost position 23", 24" of clamp 23 and roller 24 respectively.

Figure 3A:
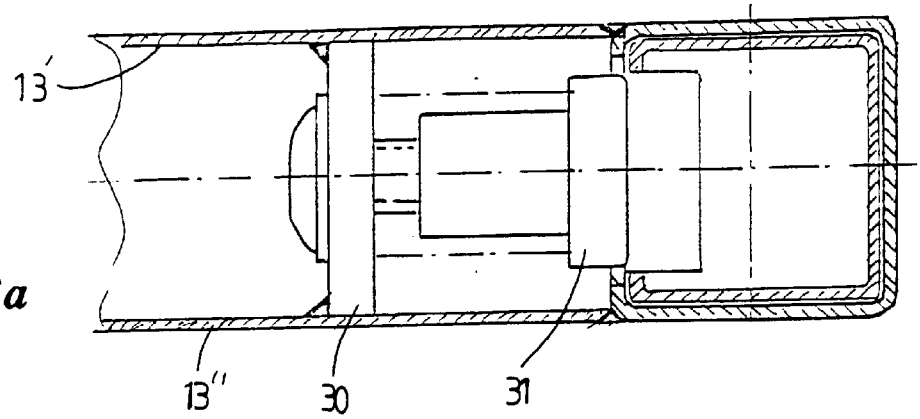
FIGS. 3*a* and 3*b* show, on a larger scale, a detail in form of a partial horizontal section (FIG. 3*a*) and a partial axial section (FIG. 3*b*) through the two-part bracket.
Figure 3B:
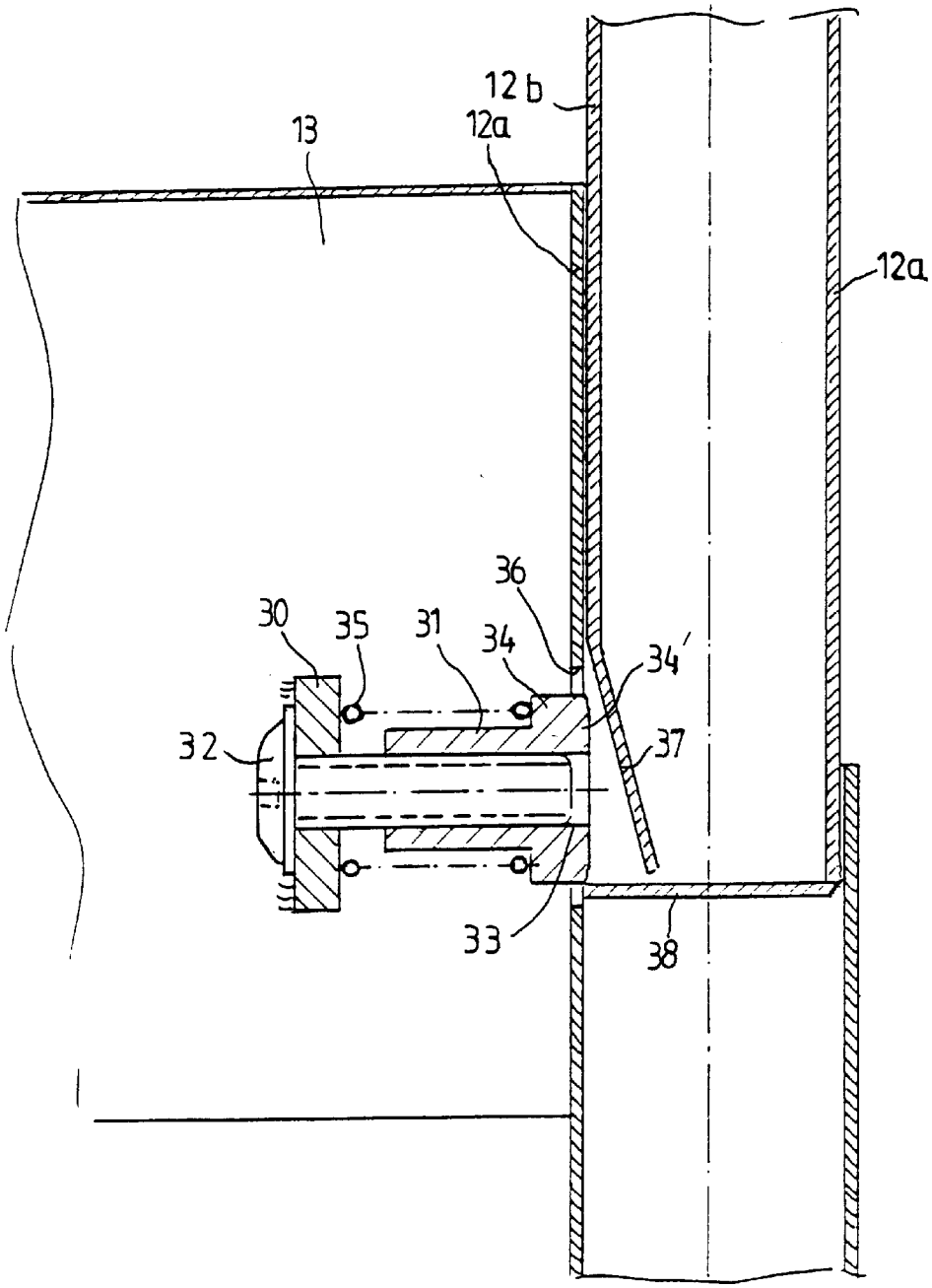

With reference to FIG. 3 the height adjustment of the bracket parts 12*a*, 12*b* will now be explained. At short distance between the top end of lower bracket part 12*a*, which ends, in the embodiment shown, lies at the same level as the top of handle 13, a cross member 30 has been welded between sides 13', 13" of said handle. This cross element serves to hold a friction and stop lock 31. Cross element 30 has been provided with a threaded bore in which a bolt 32 is screwed. This bolt is slid into a smooth bore 33 in a nylon block 31, so that said block is movable with respect to the bolt. Between the cross element 30 and a head 34 formed on block 31, a coil spring 35 is arranged.

In the wall of lower tube part 12*a* an aperture 36 is provided. Under the influence of the force of spring 35 nylon block 31 is urged, by its end face 34', against the outside of the upper bracket part 12*b* which finds itself within part 12*a*, as far as said upper part 12*b* has been pushed down sufficiently in lower part 12*a*. The pressure of spring 35 via block 31 on-bracket part 12*b* will therefore, also in the unloaded condition of scoop 3, a swivelling moment of force which creates friction between the tubes comprising the bracket parts 12*a* and 12*b*. This friction is sufficient to keep the bracket parts in any position, one with respect to the other, but it can easily be surmounted by hand when the horizontal part 17 of the bracket is grasped and is pulled upwards or pressed downwards in order to change the height of the scoop bracket.

Close to the lower end of upper bracket part 12*b* the wall thereof against which nylon block 31' urges by means of its head face 34', has been cut loose from the adjacent walls and is bent obliquely inwardly, so that a lip 37 is formed. A plate 38 is welded against the open lower end of the tube material comprising the upper bracket part 12*b*. When upper part 12*b* is pulled upwards, head 34 of block 31 will, at a certain moment, be capable of being pushed inwardly by the spring until it reaches a position which is slightly further down the unstable position as has, for the sake of clarity, been chosen for the representation in FIG. 3; and plate 38 will come to abut against the bottom of head 34 and will prevent upper part 12*b* from being pulled further upwards, thereby leaving lower bracket part 12*a*.

When, by manual force, upper part 12*b* is pushed downward again, oblique lip 37 will again urge head 34 of block 31 against its spring action to the left such that, after a few centimeters, lip 37 has completely passed block 31, and this block will again, creating a swivelling moment of force and the resulting friction, provide for the frictional fixation of the mutual position of parts 12*a* and 12*b* at any moment of time.

Finally, in this connection, it is pointed out that the functioning of clamp 23 is independent of the relative height position of the bracket parts. In FIG. 2 the highest position of the bracket parts has been represented in full lines, and now roller 24 will be urged against horizontal part 17. When upper bracket part 12*b* has pushed further down into lower bracket part 12*a* in order to reduce the overall scoop height, clamp 23 will obtain a highest position adapted thereto, in which roller 24 will still be urged against arm 17 of the bracket, but in a condition slightly rotated in clockwise direction relative to the one represented in FIG. 2*a*. Position 23' is the highest position of the clamp when bracket parts 12*b*, 12*a* have been pushed in as far as possible. Position 23" is the lowermost position of clamp 23, irrespective of the relative height condition of bracket parts 12*a*, 12*b*, because roller 27 will abut against bracket part 12*a*.

In general, the device according to the invention is used in the following manner.

The order collector stops as usual close to the order-collection pallet. He/she takes the order-collection scoop by the grip 14 and/or one of handles 20, 20' and pays out the hoisting wire 8 by means of operating button 16 in handle 13 as far as is necessary in order to be able to place the support blade 9 of the order-collection scoop under a package on the order-collection pallet. He/she then depresses the lifting button, as a result of which the order-collection scoop is pulled backwards. In the process, the order collector allows the scoop also to tip over slightly, so that it travels on rounded edge of upright 10 and the scooped-up package is in fact carried along (obviously, this is not required for the front packages on the pallet). When the order-collection scoop leaves the pallet, it is hoisted up. Since the order-collection scoop 3 is already more or less balanced, the order collector can keep the scoop 3 in check and control it very easily by means of the relatively long handle 13. Since the pulley over which the hoisting wire 8 runs hangs centrally above the pallet brought along on the order-collection truck, the package situated on the order-collection scoop can easily be deposited at any desired location on this pallet.

With low-lifting and high-lifting order-collection trucks, the method is even simpler, since the order collector does not have to turn right round (only 90° instead of 180°).

The following characteristics of the order-collection scoop make the collection of orders particularly easy.

Due to the handle 13, the rearmost packages (both at the top and the bottom) can be reached easily without the order collector having to make an effort or assume an uncomfortable position.

Due to the handle 13, it is easy for the order collector to control and balance the order-collection scoop, even if the center of gravity of a package picked up is not directly beneath the hoisting wire 8 or if the latter is pulled at an angle.

The very thin support blade 9, comprising teeth 9', 9", of the order-collection scoop can be placed under any package easily and without significant physical effort.

The raising and lowering operation is carried out using the thumb of the hand which is holding grip 14 on handle 13. This can be done very easily and without any loss of time. Due to the wireless transmission of signals, no power-supply cable is in the way either.

When the order-collection scoop is supported from its wire in empty state, clamp 23 will be in its lowermost position under the influence of the scoop's own weight.

As soon as the scoop will rest upon something and there will be no more pulling force in the wire, the clamp will first go down as soon as the bottom "going down" is pushed. After that, the lowering displacement will automatically be ended by a slack wire switch in the hoisting gear.

When raising, after having scooped an article, the clamp will first go down until it comes to rest upon the top of the article.

Virtually all package formats and weights which occur in practice can be picked up using the order-collection scoop (up to approx. 500 mm wide, approx. 500 mm deep and at most 450 mm high, with a maximum weight of 20 kg). Even the maximum dimensions and weights (which in practice seldom occur) can be handled without difficulty. If necessary, it is also possible to pick up a plurality of small packages simultaneously with the order-collection scoop.

Since the order-collection scoop can be tipped over slightly and then slides on the rounded edge, it can easily be moved over packages situated beneath it.

The height of the scoop 3 is adjustable to 270 mm at minimum. This prevents the bracket 12 from hitting the rack bar situated above it when picking up the top packages on a pallet. In any case, this only occurs if the relevant packages are low and the bracket therefore cannot be allowed to remain in the highest position. The height of the bracket 3 can be adjusted extremely quickly and simply.

Different designs of the order-collection scoop for warehouses of different dimensions or weights of packages are possible.

The pulley 7 on the horizontal load bar 6 which is situated above the pallets brought along (or roller containers) can be displaced into any desired position and locks automatically on raising or lowering. That position of pulley 7 which is most favorable for collection of orders can thus always be reached in a simple manner. If only one pallet or rolling container is transported on the order-collection truck, no adjustment of the pulley 7 is necessary.

The application of the invention with non-lifting order-collection trucks or electric pallet trucks will now be explained in more detail with reference to FIGS. 4*a* and 4*b* (it is thought that the use of reference numerals would not provide any improvement to the clarity of the drawings).

The typical situation is that the order collector dismounts from the order-collection truck when picking up the packages, or else he is already situated next to the truck, since it is not possible to travel on the truck, as may be the case with electric pallet trucks.

The pallet and package data are:

The loaded pallet depth may be up to 1200 mm (for example for frequently used pallets 800 mm and 1200 mm deep).

The loaded pallet height may be up to at most 1800 to 2000 mm. Sometimes, the pallet heights are significantly lower (up to 1000 to 1200 mm; two pallets are then conveyed one above the other in a truck).

The packages generally weigh a few kg, with peaks of up to approx. 15 kg, sometimes even more.

The dimensions of the packages in most cases do not exceed the dimensions 400×400×400.

A precondition for the method using the order-collection scoop is that the packages are scooped up from the pallet layer by layer, in contrast to manual order collection, where the front packages are always picked up first, in order in this way to be able to reach the rear packages better.

By scooping the packages from the pallet layer by layer, there is always a base over which the order-collection scoop can be pushed forward in the empty state or can be slid backwards in the laden state. Obviously, this does not hold for the front packages.

The method is as follows:

The order collector takes hold of the order-collection scoop by the handle and raises it to the relevant layer height of the order-collection pallet. He then allows the scoop to rest on the packages situated beneath it, pays out the hoisting wire as far as necessary and then pushes the scoop forwards at sufficient speed for the support blade to move under the package. The order collector then starts the lifting motion. As a result, the order-collection scoop is pulled backwards. In the process, the order collector allows the scoop to tip over slightly, so that the scooped-up package rests securely against the upright rear side and the scoop slides backwards. When the scoop runs off the front of the pallet layer, the hoisting speed has been increased to a sufficient extent. The order collector then allows the scoop to execute a swinging motion towards the order-collection truck. This movement can easily be kept in check and controlled by the order collector, since the handle provides a good hold and moreover has a sufficiently long lever.

The scoop is raised or lowered to the correct height to allow deposition onto the pallet brought along (or into the rolling container). However, the scoop, with the package on it, remains in position on the pallet brought along. The package is only removed from the scoop at the next order line. This method ensures that the scoop will not swing around during transport.

Advantages compared to the manual collection of orders are as follows.

As appears from the drawing, the manual collection of packages will provide considerable problems for the top and bottom packages situated at the back of the pallet. The order-collection scoop makes these packages easy to reach and, moreover, the order collector does not have to lift the weight and thus his/her body (in particular the back) is subjected to much less loading.

Figures 4A, 4B:
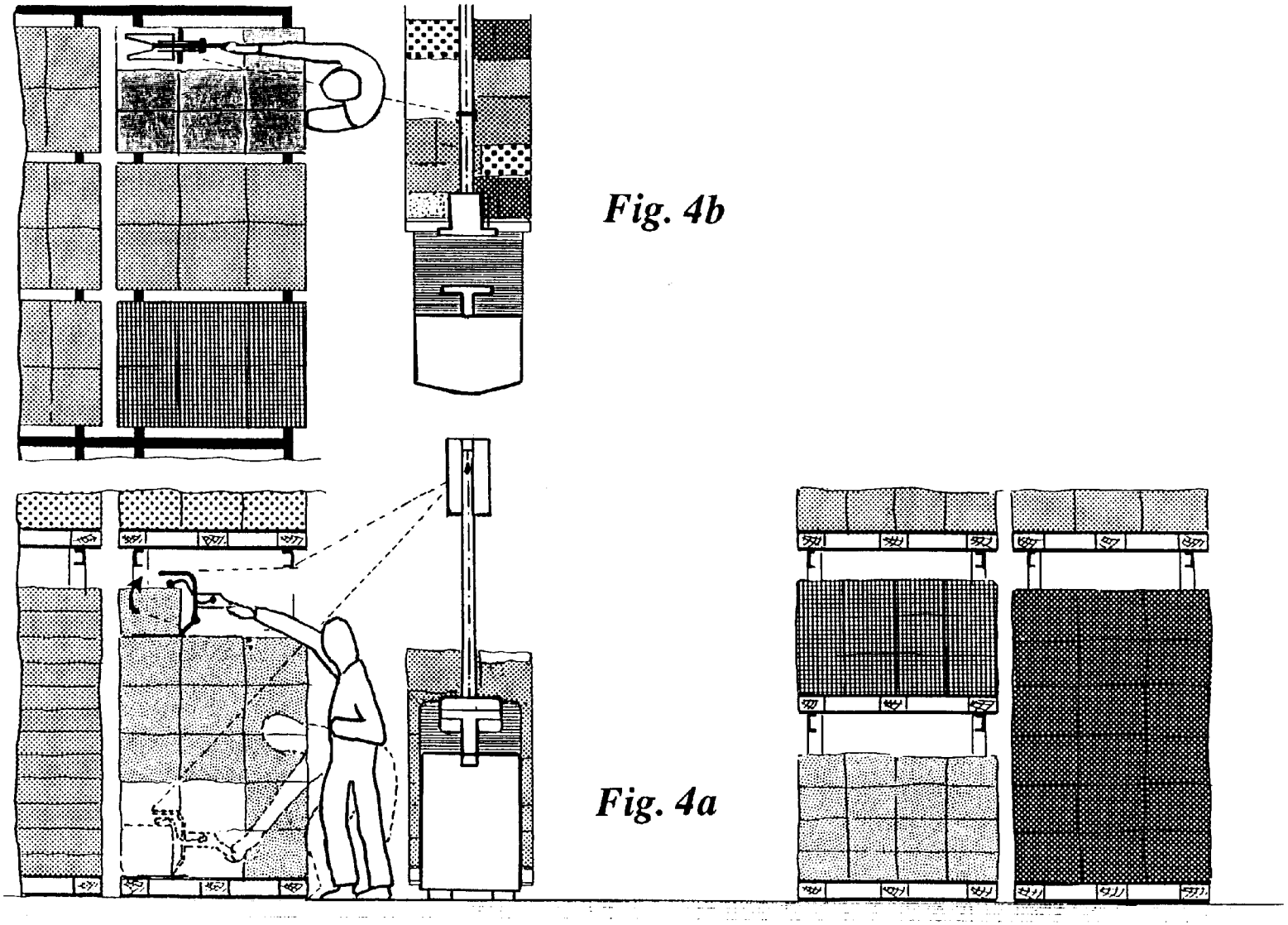
FIGS. 4*a* and 4*b* show the application of the inventive idea, specifically with the use of a non-lifting order-collection truck, in (FIG. 4*a*) a section through a warehouse with two racks and a passage between them and in (FIG. 4*b*) a top view of the rack on the left in FIG. 4*a*, including the truck.

For the low pallets, as depicted on the right in FIG. 4*a*, the order collector (when collecting orders manually) has to stoop beneath the rack bar. When using the order-collection scoop, this is not necessary. Since the picking-up time in manual order collection can constitute up to 40% of the total order-collection time, it is possible to achieve a considerable increase in capacity. The packages are picked up more quickly and a higher rate can also be maintained for a longer period.

Figure 5C:
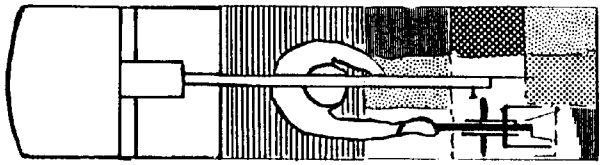
FIGS. 5*a* to 5*c* show the application when using a low-lifting truck.
Figure 5B:
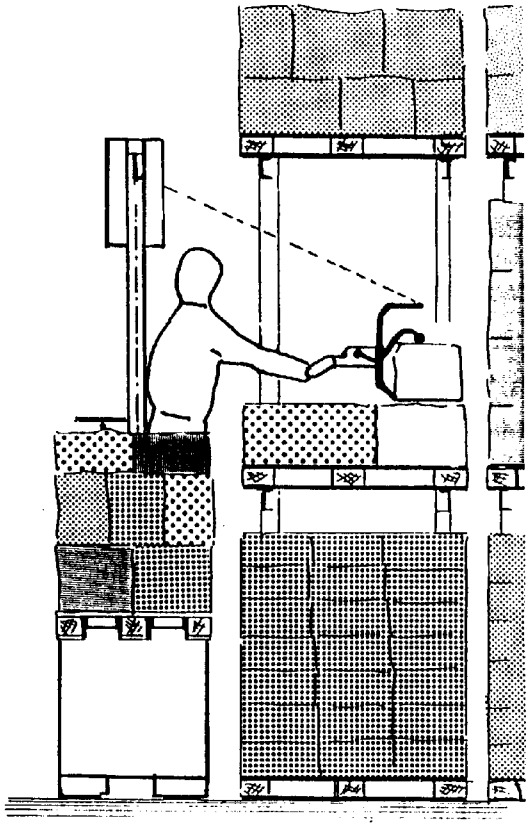
Figure 5A:
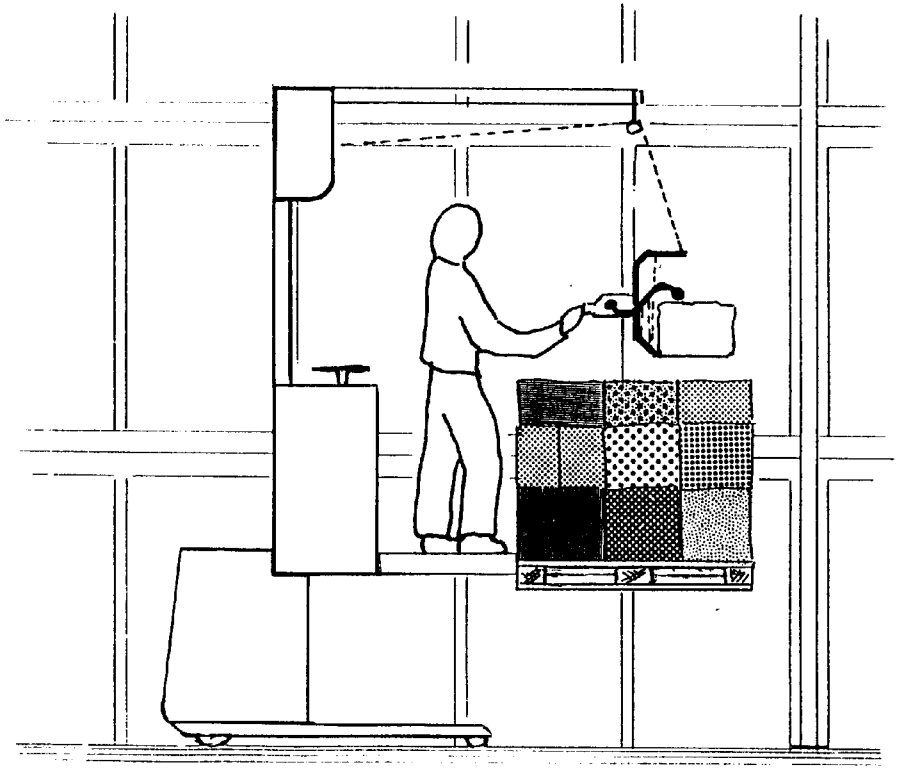
Figure 6B:
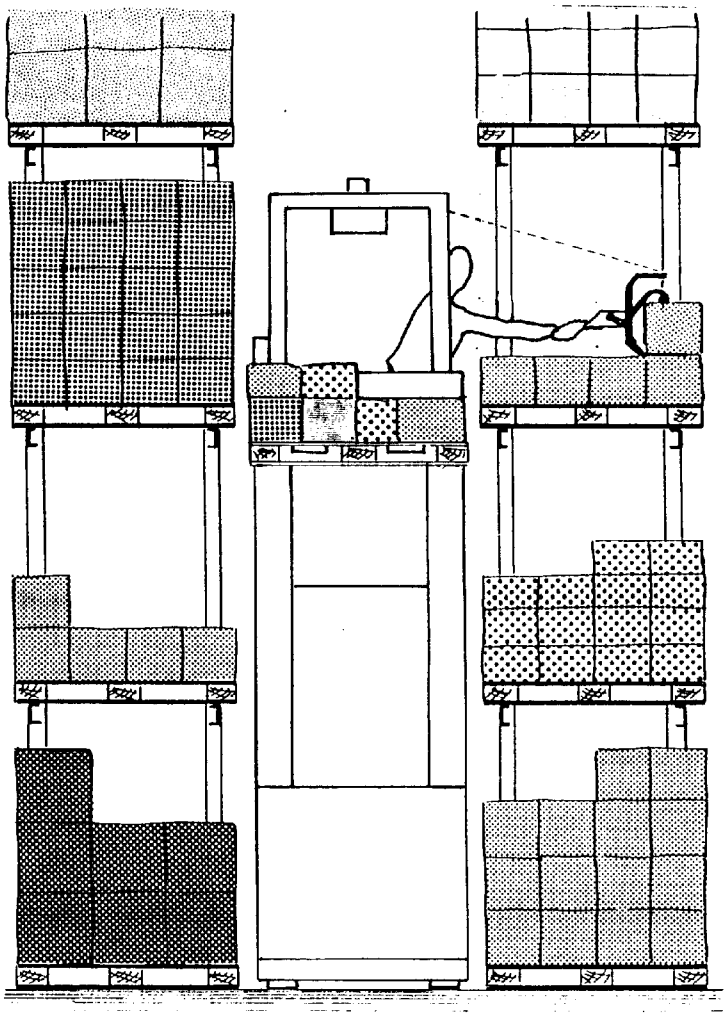
FIGS. 6*a* and 6*b* show the application when using a high-lifting truck.
Figure 6A:
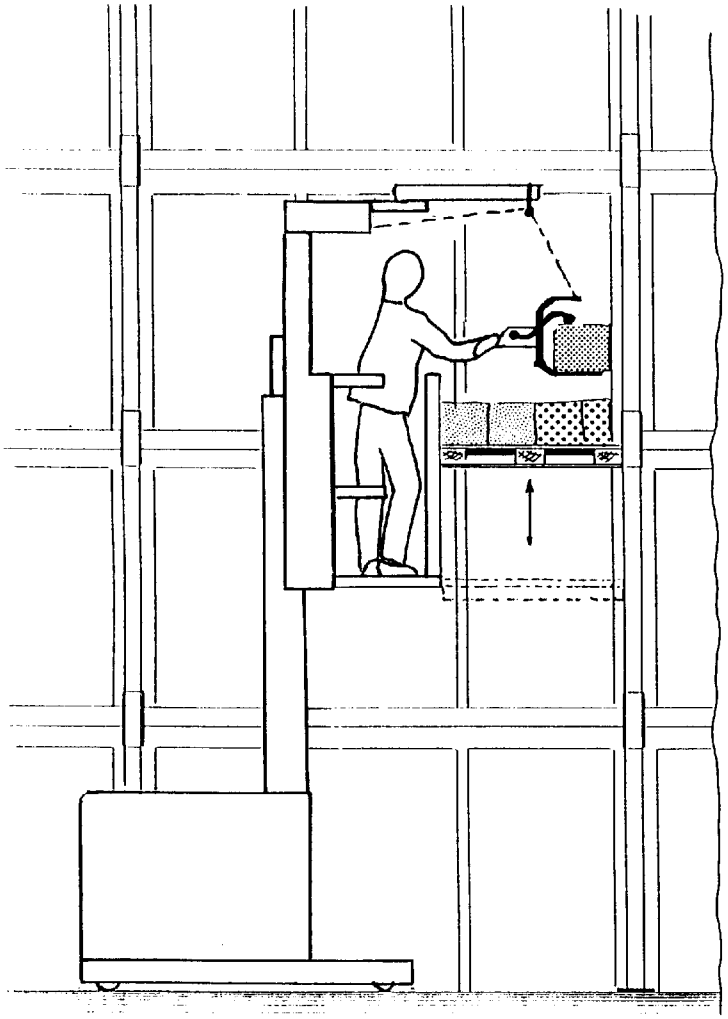

With reference to the following figures the application with low-lifting (FIGS. 5*a* to 5*c*) and high-lifting order-collection trucks (FIGS. 6*a* and 6*b*) will now be described.

The typical situation is that the order collector when picking up the packages remains standing on the platform (or in the cab) of the order-collection truck. However, he first has to turn through 180° from the direction of travel.

Only one pallet can be transported at a time with lifting order-collection trucks. Sometimes this pallet is a rolling container.

Pallet and package data are completely identical to those for low-lifting order-collection trucks (see description of FIGS. 4*a* and 4*b*).

In this case too, it is a precondition for the method using the order-collection truck-that the packages are removed from the pallet layer by layer.

In principle, the method is largely identical to that using low-lifting order-collection trucks. However, the following circumstances are more favorable.

The order collector stands centrally in front of the pallet on the order-collection truck. He only has to turn through 90° to the left or right in order to be able to place the order-collection scoop beneath a package. Furthermore, the swinging motion towards the center of the pallet brought along is very limited and is very easy to control. The scoop itself also only has to turn through 90°.

The high-lifting order-collection truck (FIGS. 6*a* and 6*b*) also has the extra advantage that the height of the pallet brought along can also be adjusted, so that placing the packages on the pallet is even simpler and easier.

Advantages of the order-collection scoop by comparison with the manual collection of orders are in principle identical to those obtained when using low-lifting order-collection trucks. However, there are some advantages which are specific to low-lifting and high-lifting order-collection trucks.

For low-lifting order-collection trucks too, in particular the top packages can be reached more easily with the order-collection scoop than with the manual method. furthermore, in particular placing the packages on the pallet brought along is somewhat easier. With the manual method, the order collector has to reach a long way (pallet depth 1200 mm) in order to stack the packages on the pallet.

With the high-lifting order-collection truck, the optimum height position can always be adopted. However, with manual collection of orders, placing packages on the back of the pallet is inconvenient if the pallet brought along is, for example, 1000 mm deep. However, this is no problem with the order-collection scoop.

To summarize, the advantages of using the order-collection scoop are as follows:

The order collector no longer has to lift the weight of the packages and moreover no longer has to reach high, deep or low. The working conditions of the order collector are consequently improved considerably. The back is no longer subjected to any loading and tiredness is prevented. Reporting sick as a result of the working conditions will thus occur less frequently. This is, inter alia, also financially advantageous for all parties involved.

Hitherto, the heavy work of order collection has mainly been carried out by men. The use of the order-collection scoop means that the work can also easily be carried out by women, since great physical force is no longer required. This provides more flexibility for the deployment of workforces and opens up new avenues for women.

Since the working conditions are affected so favorably, the productivity of the order collector will also be greater. Not only is it possible to work more quickly, but it is also possible to maintain the higher tempo for a longer period. In certain cases, it is also possible to pick up more packages at the same time than is possible with the hand alone.

Investment costs for the order-collection scoop are very low compared to the advantages and investment in the order-collection truck. The time taken to recover costs is then also extremely short, if only by dint of the saving on wage costs.

The simple and technically uncomplicated nature of the order-collection scoop means that operational reliability is also extremely high and scarcely any maintenance costs are to be expected.

What is claimed is:

1. An article hoisting scoop, said scoop comprising:

(a) a C-shaped bracket having a lower portion and an upper portion, said lower portion including a substantially vertical member, and said upper portion including both a substantially vertical and substantially horizontal member;

(b) a support blade attached to the lower portion of said C-shaped bracket;

(c) at least one handle attached to said C-shaped bracket;

(d) a hoisting cable;

(e) a suspending means to suspend the scoop from said hoisting cable; and (f) guiding means to guide said hoisting cable through the scoop between said support blade and said horizontal member of said upper portion.

2. The scoop of claim 1, wherein said C-shaped bracket comprises a two-part C-shaped bracket, said two-part C-shaped bracket having a lower part and an upper part, each said part including a substantially vertical member, said lower and upper parts adjustably attached to one another at an intermediate point along the vertical members of said parts.

3. The scoop of claim 2, wherein said lower and upper parts are slideably engaged at the intermediate point.

4. The scoop of claim 3, wherein said suspending means comprises a hoisting installation from which the scoop is suspended by said hoisting cable, wherein said guiding means guides said hoisting cable through a horizontal member of said upper part and attaches an end of said hoisting cable to said lower part of said two-part C-shaped bracket, and wherein said hoisting cable transmits the weight of the scoop and article to the hoisting installation freeing any tension in said C-shaped bracket at the intermediate point.

5. The scoop of claim 4 further comprising a spring-operated clamp, said clamp capable of engaging a top surface of an article carried by the scoop, said guiding means guiding said hoisting cable from said lower part of said two-part C-shaped bracket over a first roller mounted on said clamp and a second roller mounted on said lower part of said C-shaped bracket.

* * * * *